US007588025B2

(12) United States Patent
Raus et al.

(10) Patent No.: US 7,588,025 B2
(45) Date of Patent: Sep. 15, 2009

(54) FUME EXTRACTOR HOOD

(75) Inventors: Dragan Raus, Pordenone (IT); Marco Puppin, Venice (IT)

(73) Assignee: Electrolux Professional SpA, Pordenone (IT)

( * ) Notice: Subject to any disclaimer, the term of this patent is extended or adjusted under 35 U.S.C. 154(b) by 396 days.

(21) Appl. No.: 11/334,289

(22) Filed: Jan. 18, 2006

(65) Prior Publication Data

US 2006/0191924 A1 Aug. 31, 2006

(30) Foreign Application Priority Data

Feb. 17, 2005 (IT) ..... PN2005A0012

(51) Int. Cl.
*F24C 15/30* (2006.01)

(52) U.S. Cl. ..... 126/24; 126/1 R; 126/299 D; 126/300; 126/389.1; 454/56; 454/61; 454/369; 110/203; 110/204; 110/235; 219/757

(58) Field of Classification Search ..... 126/24, 126/299 R, 299 E, 19 R, 21 R, 21 A, 299 D, 126/300, 301, 389.1, 312, 288, 122, 286.5; 454/198, 56, 61, 49, 369, 347; 55/282.2, 55/309.1, 315.1, 490.2, DIG. 36; 219/757, 219/685, 396, 397, 400; 96/417; 165/156; 435/264; 110/203, 204, 235; 348/739
See application file for complete search history.

(56) References Cited

U.S. PATENT DOCUMENTS 3,762,394 A * 10/1973 Newcomer ..... 126/300
3,827,343 A * 8/1974 Darm ..... 126/299 D
4,101,299 A * 7/1978 Bertucci ..... 96/228
4,122,834 A * 10/1978 Jacobs ..... 126/299 D
4,180,049 A * 12/1979 Carr et al. ..... 126/21 A
4,475,534 A * 10/1984 Moriarty ..... 126/299 D
4,825,848 A * 5/1989 Macias ..... 126/299 D
5,671,726 A * 9/1997 Hsu ..... 126/299 D
5,898,818 A * 4/1999 Chen ..... 392/449
6,621,058 B1 * 9/2003 Kim ..... 219/757

FOREIGN PATENT DOCUMENTS

FR 2 739 791 4/1997
WO WO 97/48478 12/1997
WO WO 2004/060540 7/2004

* cited by examiner

*Primary Examiner*—Steven B McAllister
*Assistant Examiner*—Avinash Savani
(74) *Attorney, Agent, or Firm*—Pearne & Gordon LLP

(57) ABSTRACT

Hood, in particular associable to a cooking oven for professional kitchen applications, comprising a catalytic converter, a fan adapted to extract gases, fumes and vapors from the cooking cavity of said oven, a first intake aperture adapted to enable said gases to flow from the interior of the cooking cavity of said oven into said extractor hood, a third aperture adapted to enable said gases to be exhausted from the interior of said extractor hood into the outside ambient, a channel connecting said intake aperture with said exhaust aperture, and within which there are arranged said catalytic converter and said fan, as well as a condenser for condensing the water vapor and condensable fats contained in the gas flowing through said channel; in said channel there is provided a second intake aperture adapted to take in air from the ambient surrounding the oven. The extraction fan is arranged downstream of the catalytic converter said second intake aperture is located downstream of said catalytic converter and immediately upstream of the fan.

15 Claims, 10 Drawing Sheets

FIG 7A
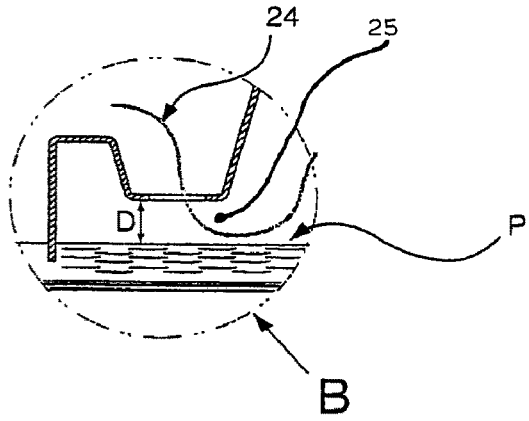
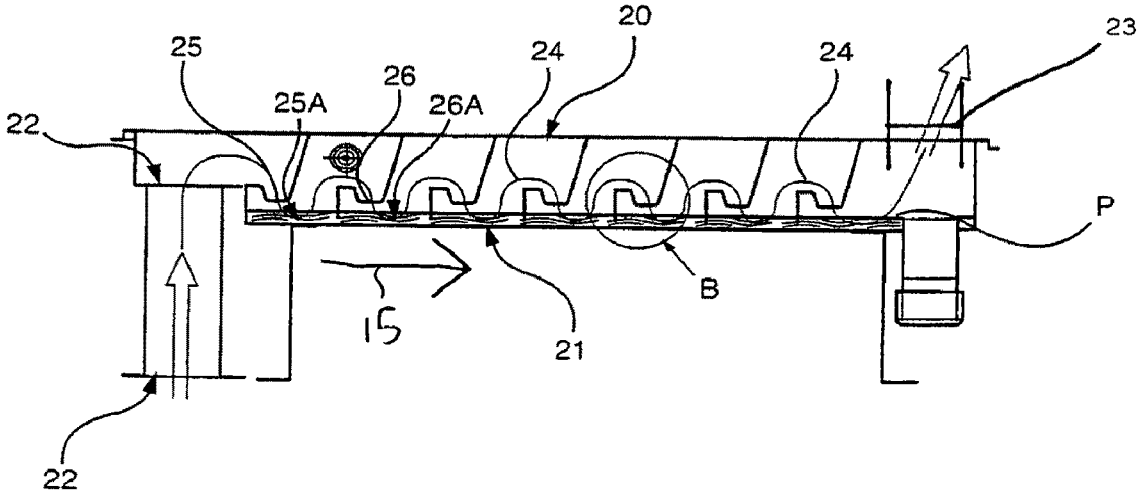
FIG 7

FUME EXTRACTOR HOOD

The present invention refers to an improved kind of extractor hood for the treatment of fumes and vapours, of the type that is usually employed for treating cooking fumes and vapours generated by food-cooking ovens for professional applications.

In food-cooking ovens of the conventional type, all gas emissions, such as vapours, fumes, odours and volatile substances in a more or less condensed state, which shall conventionally be referred to as "cooking gases" hereinafter, are both conveyed from the interior of the cooking cavity itself to be exhausted outside the oven via an appropriate flue riser and emitted directly outside from the access door of the same oven when this door is opened, thereby enabling cooking gases to directly escape into the ambient surrounding the oven.

It is widely known that in certain applications, such as in airports, readapted underground rooms of older buildings, internal rooms in very large buildings, and the like, these ovens are quite frequently installed inside fully closed rooms, in which therefore there scarcely exists a possibility for fumes, vapours and, in general, gases generated by the cooking process—and regularly emitted from the oven during said process—to be appropriately extracted and exhausted into the atmosphere by means of suitable extractor hoods and flue conduits associated thereto.

It can therefore be most readily appreciated that, if the room in which the oven is installed and used has no ways leading outside, i.e. ensuring an access to the outside atmosphere, both the cooking gases emitted through the flue riser and the cooking gases escaping through the oven door are unavoidably retained inside the same room, with the well-known unpleasant effects resulting therefrom.

In view of doing away with these drawbacks, or at least reducing the extent thereof, a practice has in the meanwhile been established in the art, which is based on the development and use of some kinds of fume extractor hoods provided with catalytic converters for the treatment of the cooking gases conveyed therethrough by the extracting action of the hood. In other words, such converters work by bringing about a catalytic reaction aimed at causing the volatile organic compounds contained in said gases to degrade.

Hoods of this kind can be embodied in a number of different ways. Examples thereof are described for instance in the (publ.) French patent application No. 2739791; a solution, in which the gases to be treated are caused to flow along a special flow-path between electrodes generating a plasma discharge, is disclosed also in the WO patent application 2004/060540.

Although quite effective in treating heavier unburnt compounds, i.e. usually condensed fats contained in the fumes exhausted by the oven, these solutions are however by no means effective in reducing or eliminating the considerable amount of moisture, i.e. water vapour contained in the same gases. In addition, such catalytic converters are almost ineffective as far as the practical ability thereof to treat emitted odours is concerned, since these odours are borne by extremely small particles that tend to escape the effect of such converters.

Hoods of the above-cited kind have also a drawback in that they are generally quite bulky, thereby implying considerable space requirements, and their installation involves the use of correspondingly adequate means and efforts. Anyway, a major, if not basic disadvantage of these hoods lies exactly in the limitation that is inherent in their very nature of hoods, i.e. in the fact that they collect a great deal of the gases issuing from the cooking means placed therebelow, but not the totality of such gases, actually.

As a matter of fact, a small amount of such gases succeeds in anyway escaping the action of the hood and ultimately expands into the surrounding ambient, where—after a certain period of time—these gases accumulate to bring about the same well-known drawbacks as already noted hereinbefore.

Disclosed in WO 97/48478 is a hood provided with a catalytic converter that, along with the gases issuing from a cooking hob placed therebelow, sucks in also gases from the surrounding ambient.

While this hood features a certainly improved efficiency in general, it however still has some serious limitations concerning its operating effectiveness, i.e.:

- a first such limitation derives from the fact that no means is actually provided to effectively remove the moisture from the air being sucked in and treated;
- a second limitation is connected to the fact that, for the catalytic converter to be activated, a source of very hot gases is placed under the hood, so that said converter is activated by these gases; this solution, however, turns out as being rather complicated and expensive as far as both manufacturing and operation of the hood are concerned;
- a third limitation is simply due to the fact that, substantially, this hood still is a general ambient hood and, therefore, not a dedicated oven hood as the one which on the contrary is the subject matter of the present invention.

It would therefore be desirable, and is actually a main purpose of the present invention, to provide a kind of hood, which is intended to be preferentially associated to a cooking oven, preferably of the type intended for use in professional kitchens, wherein said hood is provided with means adapted to suck in and intercept and treat a maximum possible amount of the gases generated by the cooking process going on in the oven; in particular, such gases being so treated by this hood are both intercepted from the interior of the cooking cavity of the oven and sucked in, i.e. taken in from the outside of the oven door. Furthermore, this hood, further to a catalytic converter, also comprises means adapted to remove moisture and reduce or filter odours from the gases flowing therethrough.

According to the present invention, these aims are reached in a fume extractor hood for cooking ovens incorporating the characteristics as recited in the appended claims.

Anyway, features and advantages of the hood according to the present invention may be more readily understood from the description that is given below by way of non-limiting example with reference to the accompanying drawings, in which:

FIG. 7 is across-sectional view of the component part of FIG. 6, as viewed along the section line A-A in FIG. 6;

FIG. 7A is an enlarged view of the encircled portion B in FIG. 7;

Figure 1:
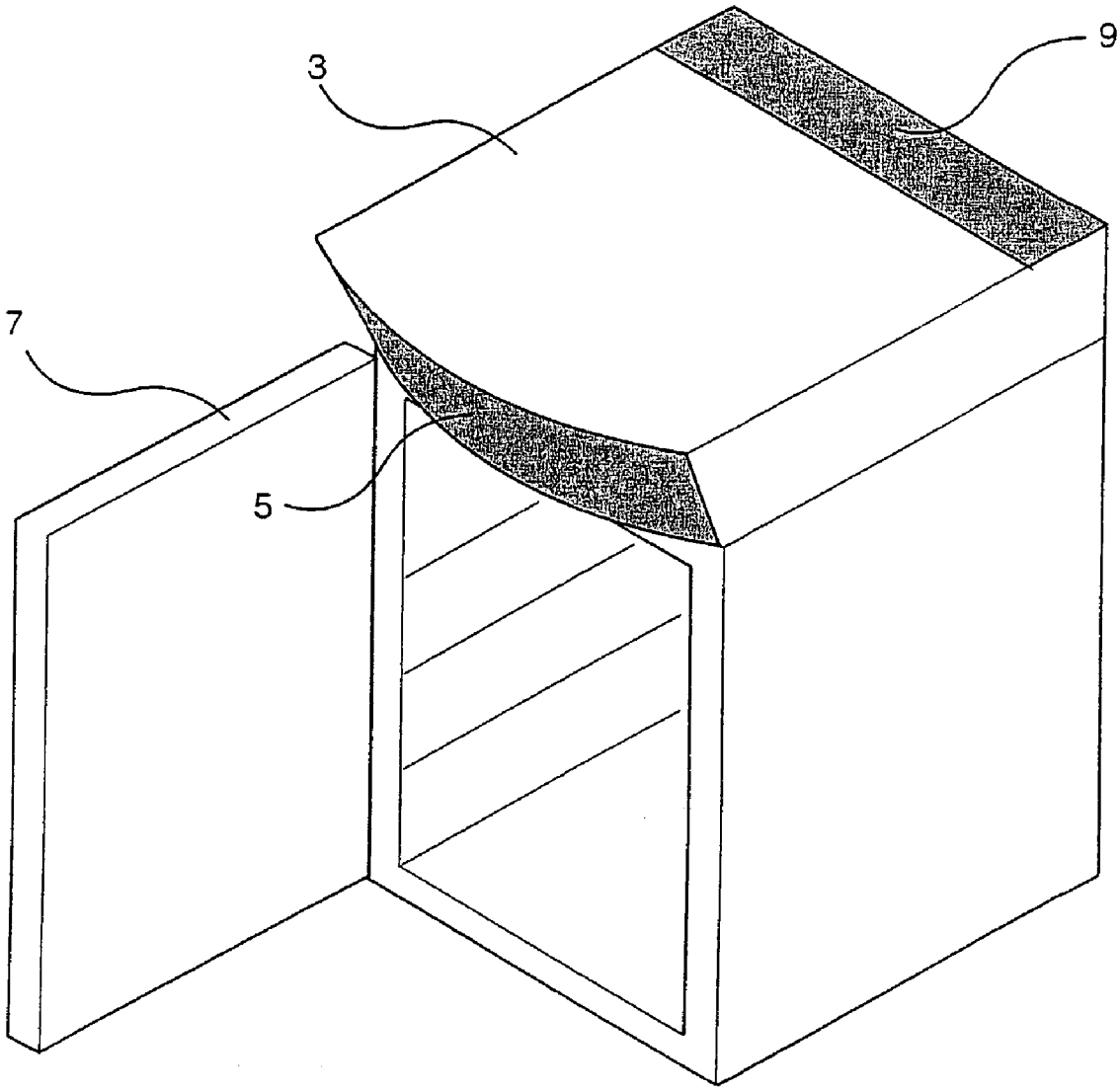
FIG. 1 is a perspective view of a fume extractor hood for extracting gases exhausted or escaping outside of the cooking cavity of an oven, according to the present invention.
Figure 2:
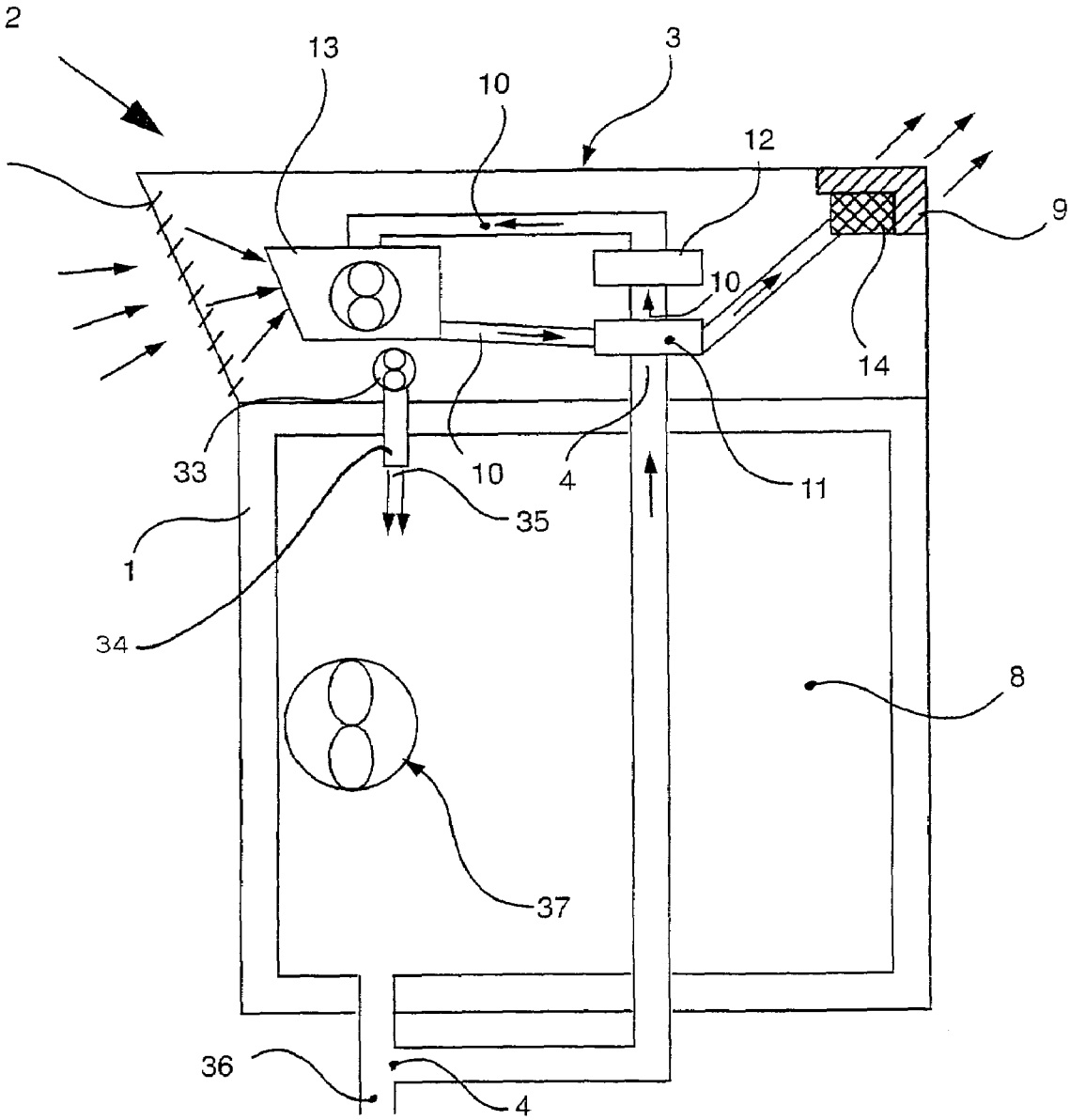
FIG. 2 is a symbolical, vertical cross-sectional view of the same hood illustrated in FIG. 1, along with its major operating component parts, as viewed in the arrangement in which it is duly interconnected with the oven.

With reference to FIGS. 1 and 2, the present invention is essentially based on the feature of providing a hood 2 that is placed upon the top surface of a respective oven 1, substantially in contact therewith, and is adapted to collect the gases that are generated and exhausted almost solely by said oven, so that said hood and said oven are able to operate under conditions of close synergy, while anyway maintaining the functional and operating peculiarities thereof.

According to the present invention, this extractor hood comprises a through-flow channel for the gases being conveyed from the interior of the oven cooking cavity, wherein in said channel there are arranged some devices for treating said gases, i.e. a condenser, a catalytic reactor and a filter; in addition, this hood is provided with an air intake for taking in air from a zone above the oven access door, wherein this air is mixed with the air that is already flowing through the channel and is caused to pass again through the same condenser, however via separate ducts, in view of causing the moisture contained in the air taken in from said front intake to condense.

Figure 3:
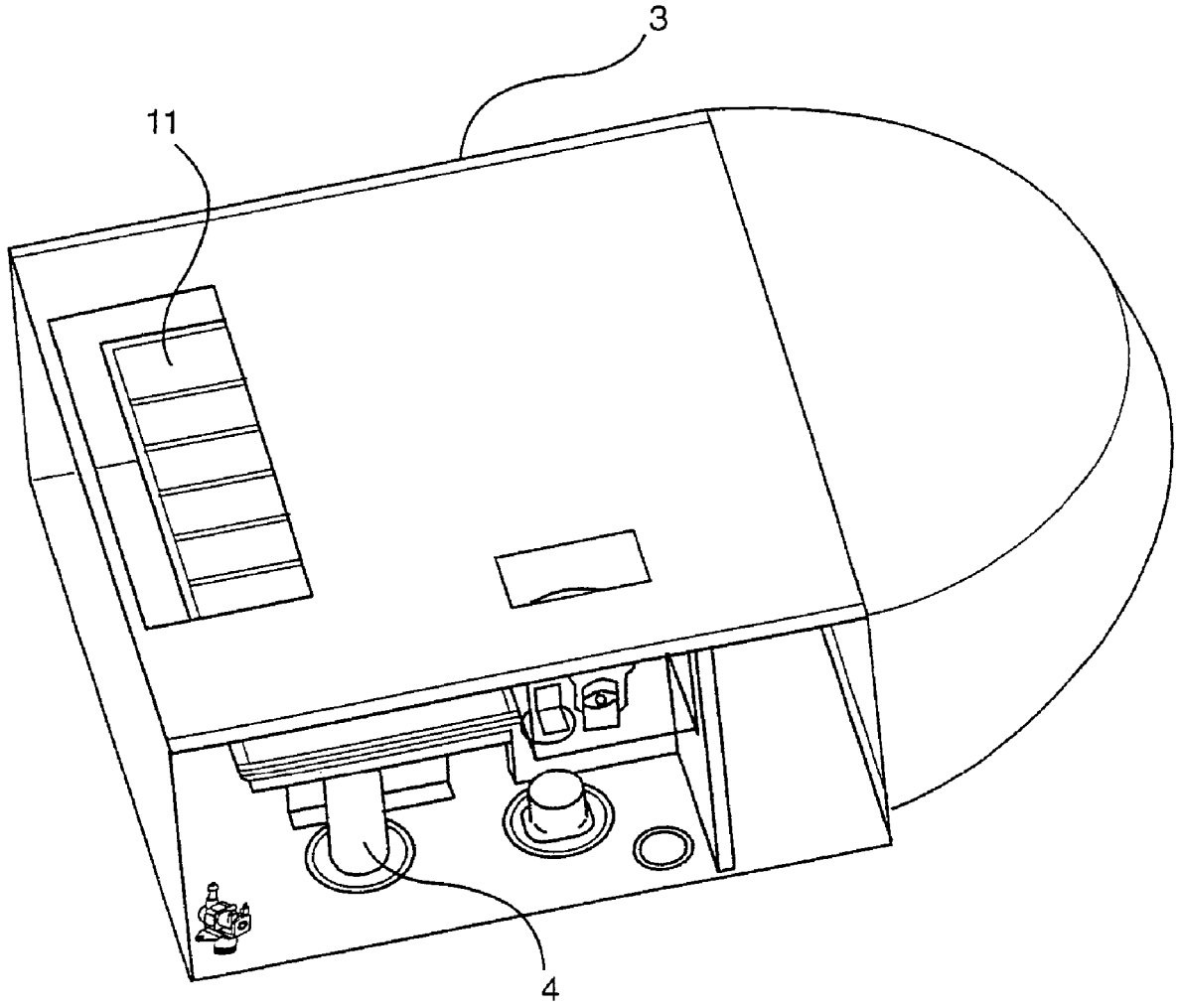
FIG. 3 is a perspective, partially see-through view of the hood illustrated in FIG. 1.

This extractor hood 2 is made and operates as described below in greater detail. To illustrative purposes, it is shown separately in FIG. 3 and is substantially comprised (FIG. 2) of an outer casing 3, inside which there are housed a number of devices that will be described in greater detail further on; this outer casing 3 is substantially closed on all sides, except for a first aperture 4 located on the bottom of said outer casing 3, a second aperture 5 located in the front portion of said casing and embodied in the form of a wide mouth opening above the oven access door 7 that closes the cooking cavity 8 of the oven, and a third aperture 9 located in the upper portion at the rear of said casing.

The apertures 4 and 5 work as suction intakes, whereas the aperture 9 works as an exhaust port that lets out into the outside ambient the gases that have been taken in and conveyed through said two apertures 4 and 5.

In the interior thereof, said outer casing 3 is provided with a through-flow channel 10 that starts from said intake aperture 4 and terminates into said exhaust port 9.

In its flow-path from said intake aperture 4 to said exhaust port 9, this through-flow channel passes through or, anyway, interacts with following devices, which are arranged in series and in a sequence relative to each other:

a condenser 11, a catalyst converter or reactor 12, a fan 13, again said condenser 11, filtering means 14.

Figure 4:
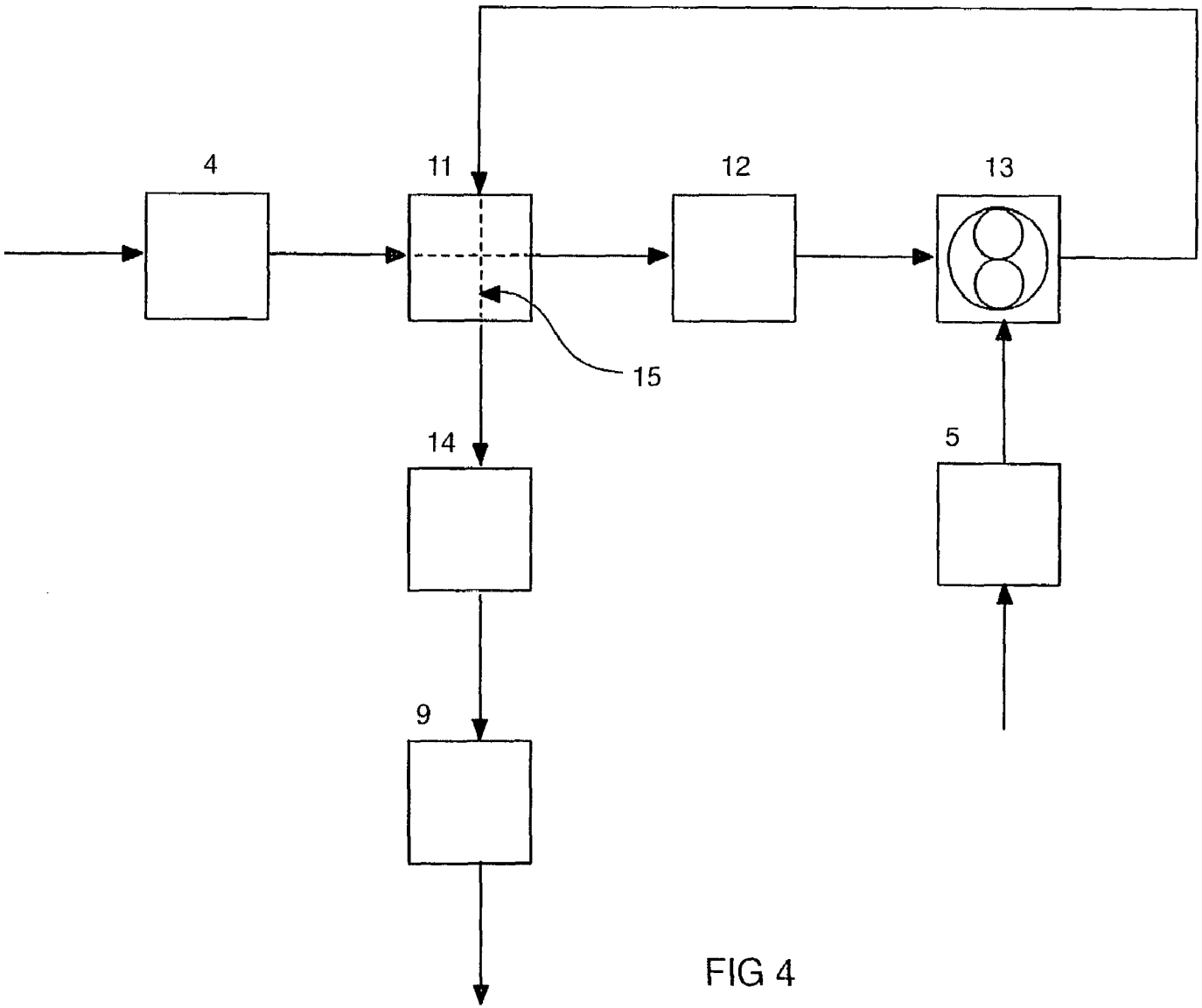
FIG. 4 is a symbolical view of the operating schematics of the inner parts and members of the hood shown in FIG. 1.

In a purely symbolical manner, FIG. 4 illustrates the association between said through-flow channel and the various above-cited devices. The main characteristics and features of said devices, which on the other hand are largely known as such in the art, shall be described in greater detail hereinbelow, along with the way in which they work in the inventive arrangement.

The condenser 11 has the task of condensing, i.e. removing most of the water vapour carried by the cooking gases being treated, along with a fraction of the condensed fats that are also present in said gases. To this purpose, this condenser is a typical gas/liquid condenser, wherein the cooling element is a flow of cold water, preferably water let in directly from the water supply line. Owing to the function thereof being a twofold function, actually, in the sense that it has to treat two distinct gas flows, it is provided with a particular structure. In fact, with reference to FIGS. 5, 6 and 7, such condenser can be noticed to be provided in the form of a box-like structure 20, of a shallow type, arranged with a preferably extended wall 21 thereof—constituting the bottom of said box-like structure—on the horizontal plane.

On the two opposite sides of said structure 20, there are provided two respective ports 22, 23, in which a first port 22, acting as an inlet mouth, is connected on the side of said first aperture 4, while the second port 23 is connected to said channel 10 on the opposite side, i.e. towards the catalytic converter 12.

Between said two ports 22 and 23 there is provided a duct 24, which has a distinctive peculiarity in that it is shaped in a substantially coil-like, i.e. serpentine form on the vertical plane. In other words, it is defined by a plurality of such guide elements as to have this duct initially led towards said bottom 21, towards which it features a first downwards open access zone 25, after which this winding duct 24 starts to move upwards again until it then moves again downwards, towards a second downwards open access zone 26, from which it rises again, and so on.

Basically, this serpentine looks much like the contour of a wave train, wherein each trough between adjacent waves is open towards the bottom.

On this bottom there is available the condensation medium, preferably a thin water layer—just a few millimetres high—delivered by an appropriate nozzle 27, as this shall be described in greater detail further on.

Between the free surface P of said water layer and the lowest portions 25A, 26A, etc. of said serpentine and, anyway, in the highest zone of the trough thereof, there exists quite modest a difference in level "D", which is anyway adequate in ensuring that the gas flow passing through said serpentine is able to go in all cases on, since the liquid does not reach up high enough as to act as a "plug" obstructing the passage of said gas flow. This can on the other hand be also explained by saying that, in the lowest regions or zones thereof, this serpentine is not obstructed by any water seal, i.e. the water head does not form any seal, while there remains in all cases an aperture, i.e. free flow cross-section that is sufficient to enable the gas flow to pass unhindered therethrough.

This is anyway fully apparent and best illustrated in FIGS. 7 and 7A.

The moist and hot fractions of the gas can in this way be effectively condensed owing to this gas coming repeatedly in contact with the surface of the cold water as it flows on, so that said moist and hot fractions are able to precipitate and condense directly on the upper surface of the underlying water layer.

It has also been found experimentally that this architecture of the condenser, i.e. the above-noted serpentine-like form thereof on the vertical plane, is more effective than a simple condenser in which the gas flowing therethrough is caused to move in contact with a cold surface along a planar, laminar flow-path. Theoretically, this may also be explained with the fact that condensation is favoured not only by the large surface area available for a direct contact of the hot gases with the cold surface of the cooling liquid, but also by the fact that there occurs a mixing process and, therefore, a turbulence is induced in the flow of the hot gases themselves, so that these gases are almost totally exposed to and, as a result, effectively cooled down by the surface of the cold liquid.

The desired level of the water in said condenser is ensured by providing said bottom 21 with an appropriate drain siphon 28, so that the height h of the upper edge of said siphon from said bottom 21 automatically determines the height of the free surface P of the water and, as a result, also the performance characteristics and the flow resistance, i.e. pressure drop of the condenser.

Obtained in this way is also an automatically occurring elimination of condensed substances, since these substances, owing to them being transferred into the cooling liquid, are unavoidably let off with the portion of such cooling liquid that in an almost continuous manner flows over the upper edge of the siphon 28.

In an advantageous manner, this condenser is supplied with a stream of water flowing in directly from the water supply mains under control of an appropriate electromagnetic valve 29. By acting with largely known means upon such electromagnetic valve, it is therefore possible for the operation of said condenser to be activated or stopped.

Figure 5:
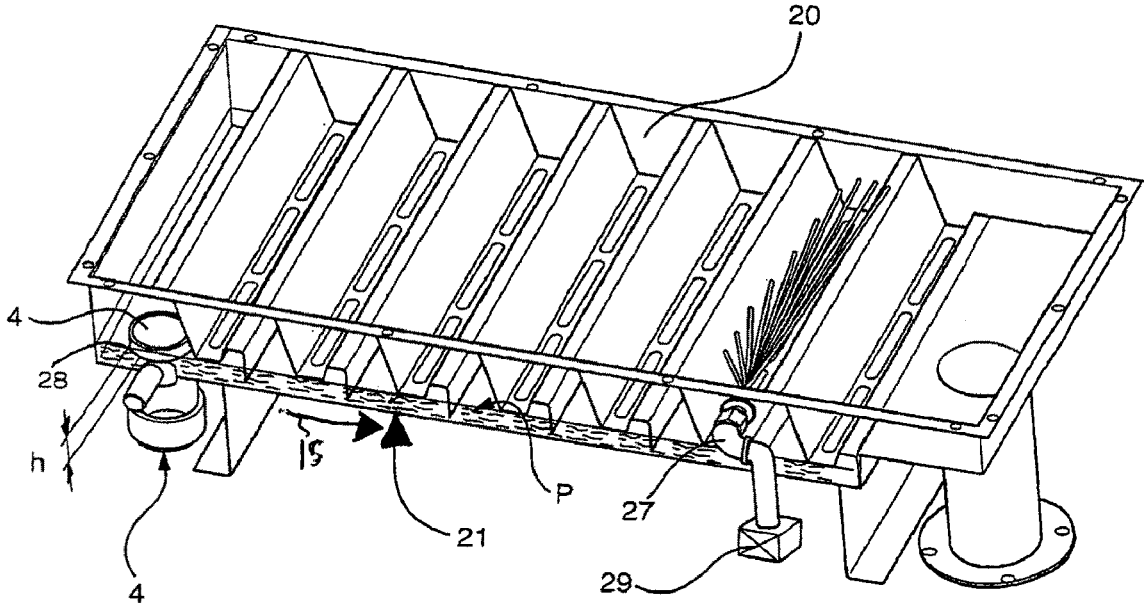
FIG. 5 is a see-through view of an operating part of the hood shown in FIG. 1.
Figure 6:
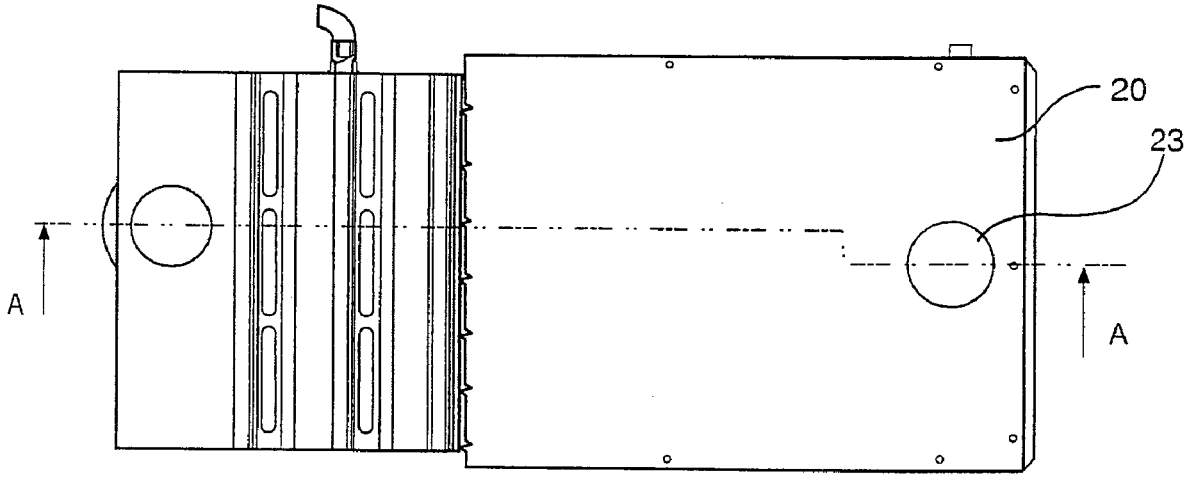
FIG. 6 is a plan top view of the operating part shown in FIG. 5.

On the other hand, this technique based on the use of a stream of water from the water supply mains for cooling the condenser allows for a further useful improvement: in fact, with reference to FIG. 5, said stream of water is let into the condenser via a nozzle 27 that is raised relative to the water surface P and provided so as to be able to generate and issue a highly atomized jet over a short portion of said serpentine-like duct, which then drops onto the bottom 21; although such atomized jet is limited in the length thereof, it has however been found that, by immediately and totally mixing with the flow of hot gases, it is effective in readily starting to remove the moisture from these gases to a significant extent, thereby improving the general performance capability of the condenser.

This condenser is also provided with means adapted to treat a second flow of air, actually; however, this further feature shall be described in greater detail further on.

Downstream of the condenser, the through-flow channel 10 reaches and connects to the catalytic converter or reactor 12, which may be of a kind generally known as such in the art, and in which the condensed fat substances that, as contained in the gases, anyhow succeeded in getting through the condenser, are resolved accordingly.

Once past the catalytic converter 12, this through-flow channel reaches then the fan 13, which serves the purpose of generating the movement of the gases through and along the through-flow channel 10, i.e. to bring about the intake and exhaust effect through the respective ports.

Upstream of said fan 13, the through-flow channel opens up for a short distance in order to enable it to connect to said second aperture 5; since this second aperture 5 is so connected to the inflow side of said fan, it can therefore be readily appreciated that this fan also works to take in air through said aperture, so that a single fan is ultimately used to take in both the gases from the cooking cavity of the oven and the air surrounding the same oven.

In addition, this second aperture 5 is sloping forwards and is approximately as wide as the access aperture of the oven; it is furthermore high enough as to ensure that, when the door closing said access aperture of the oven is opened, the gases existing inside the oven cavity, which tend to escape therethrough in an ascending flow pattern, are effectively captured by said second aperture, which is in fact so arranged as to almost totally intercept the ascending flow thereof.

Downstream of the fan, the flow moving through the channel 10, which is at this point made up by both the cooking gases and the air taken in through the aperture 5, is conveyed again towards the condenser 11, wherein this however occurs via a flow-path 15 (see FIG. 4), which is distinct from the first flow-path described above, so that the two gas streams do not cross each other and do not mix with each other, since this would almost totally thwart the advantages of the present invention, actually.

The purpose of this second passage through the condenser is to cause the considerable moisture content of the air taken in through the second aperture 5 to condense and, as a result, be removed therefrom. As a matter of fact, being generally just escaped from the oven interior, this air is clearly moisture-laden.

Figure 8:
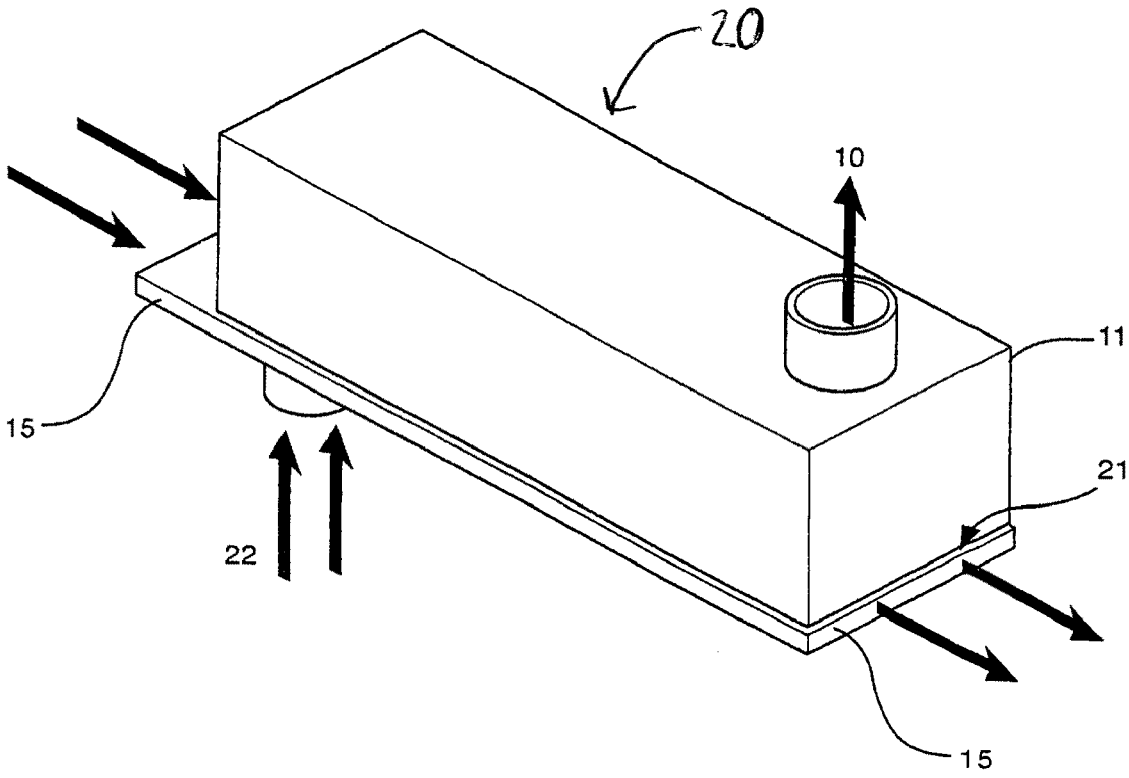
FIG. 8 is a view of an improved embodiment of the component part shown in FIG. 7.

With reference to FIG. 8, this separate flow-path is provided in the form of a second duct 15 that extends along at least one of the condenser walls, and preferably under the bottom wall 21 thereof, on which the cooling liquid is flowing. In this way, even this second air stream is caused to come into direct contact with the "cold" wall of the condenser, so that full condensation efficiency is ensured as far as even this gas flow moving through this second flow-path 15.

It will anyway be readily appreciated that additional flow-paths extending parallel to said flow-path 15 may of course be provided, as well.

Going back to the function of said second aperture 5, it should be noticed that, even when the oven door is closed, said second aperture 5, which is oriented towards the ambient surrounding the oven, works as an extractor hood of a traditional kind, actually.

A further advantage of the present invention should moreover be noticed. This in fact derives from the circumstance that, to take in the two flows of air, i.e. from the interior of the cooking cavity and the ambient surrounding the oven, a single fan is used instead of two distinct ones. Furthermore, a single condenser—and not two distinct ones—is used to condense the moisture from the air flowing in from the two apertures 4 and 5.

Figure 9:
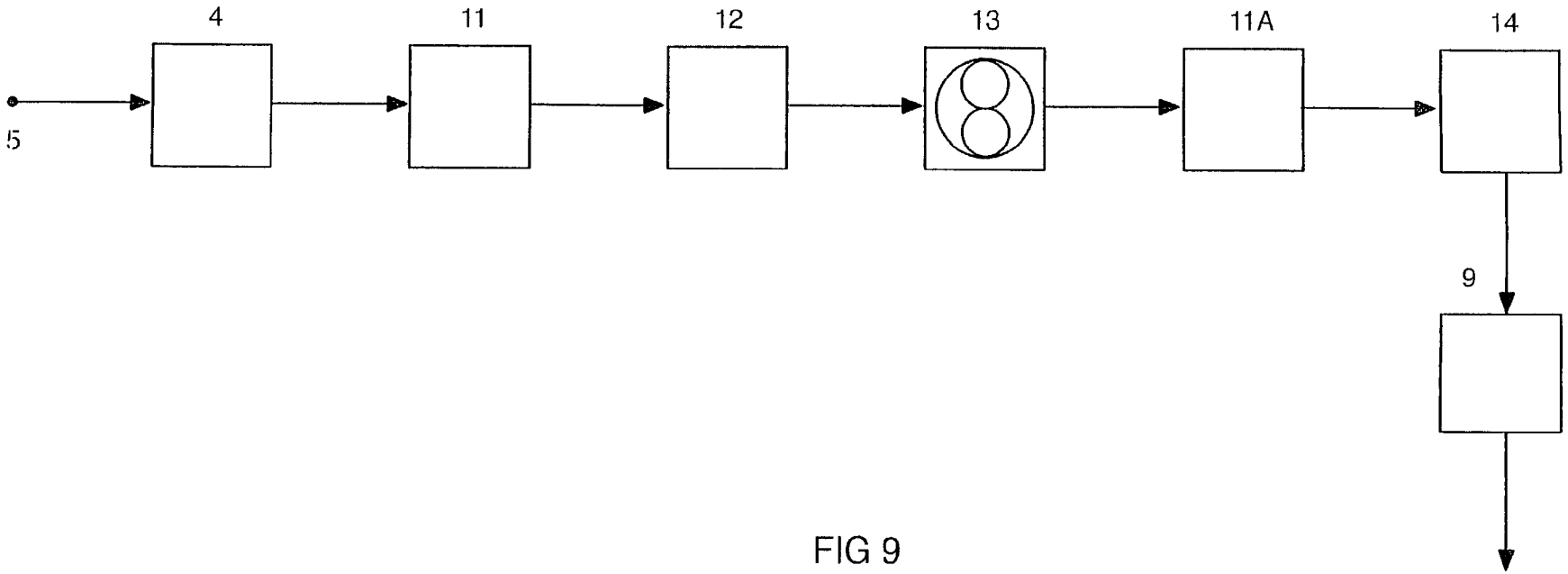
FIG. 9 is a view of a modified embodiment of the operating diagram illustrated in FIG. 4.

This, of course, is an improved embodiment of the present invention as compared with the one that may be considered as a more immediately conceivable embodiment consisting in providing two distinct condensers 11 and 11A, as this is shown in the diagram appearing in FIG. 9, wherein this more basic embodiment, however would unavoidably have the resulting drawbacks of a much bulkier overall size, and corresponding space requirements, and higher production costs.

After this second passage through the condenser 11, the through-flow channel 10—immediately before reaching the exhaust port 9—moves through the filter 14, which is made and provided in the form of a conventional air filter using the elements that are typically provided to eliminate or reduce the odours from the air flowing therethrough. Therefore, since this filter is of an inherently known kind, e.g. based on the use of zeolites, no need arises here for it to be explained or described to any greater detail.

The invention, as it has been described above, features another advantageous improvement: it may in fact occur that, for a number of reasons that do not need being dealt with any closer in this context, the head of the fan 13 proves inadequate to take in the gases from the cooking cavity of the oven to an acceptable extent (this may for instance occur due to both the condenser and—above all—the catalytic converter acting as choking members with respect to the flow of gas moving therethrough).

Figure 10:
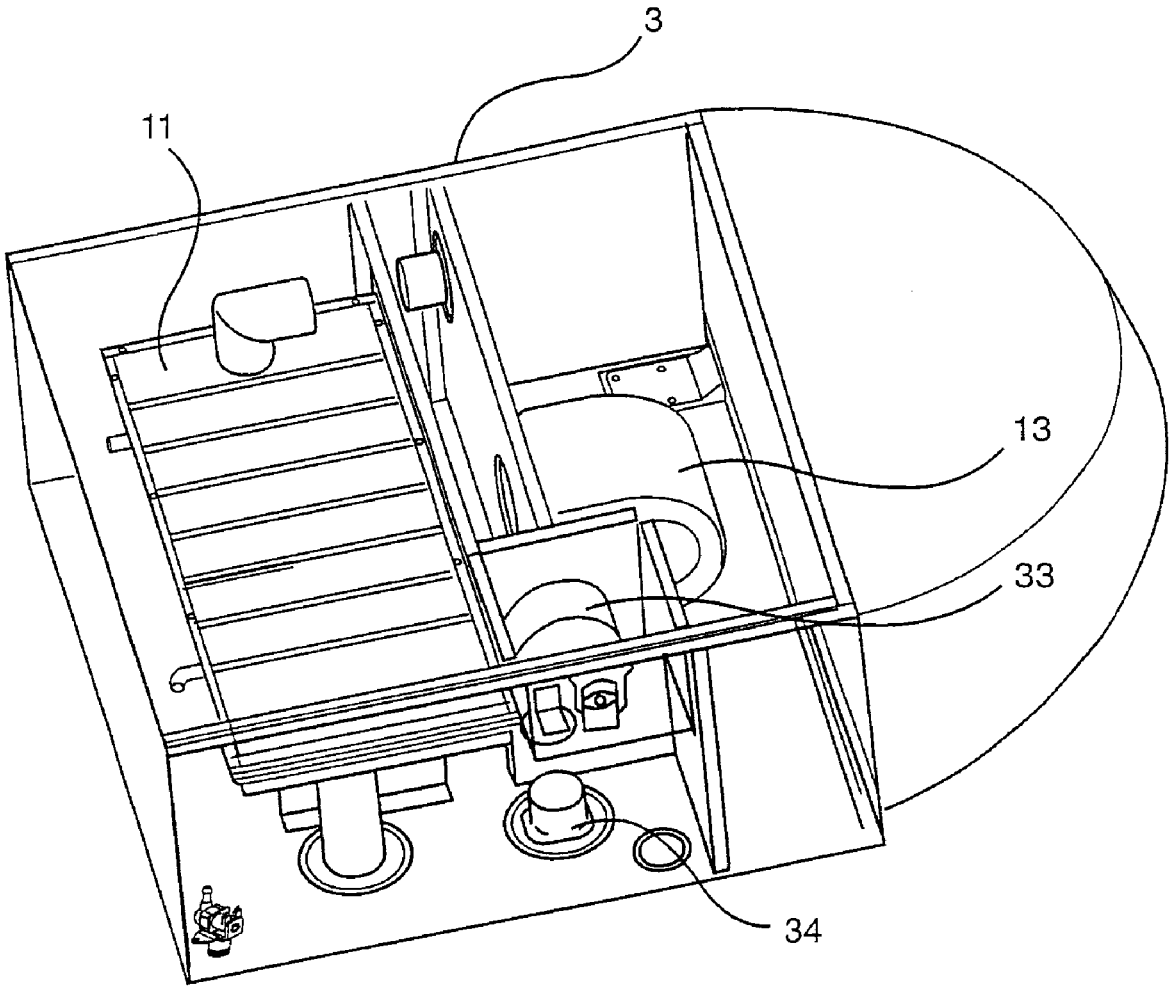
FIG. 10 is a perspective, partially see-through view of an improved embodiment of the hood shown in FIG. 1.

In view of doing away with this drawback, and with reference to FIGS. 2 and 10, inside the outer casing 3 there is arranged a secondary fan 33, which works by taking in the air from the outside ambient and delivers it—via a secondary duct 34—into the cooking cavity of the oven.

The action of this secondary fan 33 causes therefore the pressure within the cooking cavity of the oven to slightly increase, so as to facilitate the flow of the gases from the interior of such cavity, through said first aperture 4 and into the through-flow channel 10; basically, via the through-flow channel 10 and the cooking cavity of the oven, which works as a conduit in this case, this secondary fan 33 is connected in a series arrangement with the fan 13, so that the aggregate action developed on the flow of gases moving through the through-flow channel 10 is markedly strengthened.

The action of said secondary duct 34 becomes increasingly effective as the outflow port 35 thereof is brought into a position lying on the opposite side relative to said first aperture 4, so that the whole cooking cavity is more easily and readily exposed to the air flow that is blown in by said secondary fan 33 and eventually taken out by the fan 13.

With reference to FIG. 2, this outflow port 35 is located on the upper portion of the cooking cavity, since said first aperture 4 is situated in the bottom of the same cooking cavity or, more exactly, under said bottom, since it is situated directly in the exhaust duct 36.

However, when the oven is provided with a fan 37 for circulating the air inside the cooking cavity operating in a forced-convection mode, a different and quite advantageous embodiment may be identified, in which said outflow port 35 is located directly behind said air-circulating fan 37. This practically enables also the intake and, as a result, "pushing" action exerted by this air-circulating fan on the air blown in through said outflow port 35 to be used to further advantage, thereby enhancing the flow of air blowing in from said secondary duct 34 accordingly.

As far as the control and actuation functions of this oven are concerned, they are based on the use of a central control unit (not shown), which is duly connected—via usual wire leads—to the above-cited functional units of the apparatus, i.e. the catalytic converter, the two fans and possibly the electromagnetic valve 29 used to control cooling water inlet to the condenser.

It can be readily appreciated that, in a most advantageous manner, this central control unit is connected to the programme sequence and operation control means normally available on the oven, so that the possibility is given to control the operating cycles of both the oven and the extractor hood using a single programme sequence control means; in a still more advantageous manner, appropriate measures can be taken so that, by solely setting a cooking cycle of the oven, both this cooking cycle and—automatically—a pre-defined, corresponding operating cycle of the extractor hood are activated. Anyway, such interlinked control and operation of the oven and the extractor hood is well within the abilities of those skilled in the art, so that it shall not be explained here to any greater detail.

The invention claimed is:

1. Hood (2) for extracting and treating cooking gases, in particular associated to a respective cooking cavity (8) of an oven (1) as used to cook food in professional kitchen applications, comprising:

a catalytic converter (12), an extracting fan (13) adapted to extract gases, fumes and vapours from the cooking cavity (8) of said oven, a first intake aperture (4) adapted to enable said gases to flow from the interior of the cooking cavity (8) of said oven into said extractor hood, a third aperture (9) adapted to enable said gases to be exhausted from the interior of said extractor hood into the outside ambient, a channel (10), including also successive separate sections, defining a flow path which connects said intake aperture with said exhaust aperture, and within which there are arranged said catalytic converter (12) and said fan (13), a first condenser (11) adapted to condense the water vapour and condensable fats contained in the gas flowing through said channel, said condenser being traversed by the flow of gas that moves through said channel, and a secondary fan (33) that, via a secondary duct (34) and a respective outflow port (35), conveys a stream of air taken in from outside into said cooking cavity (8), so as to increase the pressure within said cooking cavity wherein said flow path is arranged in such a way that said gases, fumes, and vapours, from inside said cooking cavity (8), after traversing said first condenser (11) and said catalytic converter (12), come into contact with at least a wall of said first condenser (11) before exiting to the atmosphere.

2. Hood according to claim 1, characterized in that in said channel there is provided a second intake aperture (5) adapted to take in air from the ambient surrounding the oven.

3. Hood according to claim 2, characterized in that said extraction fan (13) is arranged downstream of said catalytic converter, and in that said second intake aperture (5) is located downstream of said catalytic converter and immediately upstream of said fan (13).

4. Hood according to claim 3, characterized in that, downstream of said fan, said through-flow channel (10) extends across a second condenser (11A).

5. Hood according to claim 4, characterized in that said second condenser (11A) is integrated in said condenser (11) and is provided so that the gas stream flowing in from said first intake aperture (4) does neither cross nor mix with the gas stream flowing in from said fan (13).

6. Hood according to claim 5, characterized in that said first condenser (11) is comprised of a box-shaped structure (20), subdivided by a planar horizontal partition (21) into an upper channel and a lower channel (15), in which a layer of cooling liquid is sprayed onto and lies upon said planar horizontal partition (21), and in which said upper channel is provided with means adapted to:

cause the gas passing therethrough to flow along a flow-path in a substantially serpentine-like shape extending in an alternately undulating pattern on a vertical plane, and cause the gas flowing through said upper channel to move in contact with said layer of cooling liquid in the lower portions of said serpentine-like flow-path.

7. Hood according to claim 6, characterized in that said through-flow channel (10) extending from said first intake aperture (4) passes through said upper channel of said condenser (11), and the section of said through-flow channel that extends from said fan (13) passes through said lower channel (15).

8. Hood according to claim 7, characterized in that on the upper surface of said partition (21) there are provided siphon means (28) adapted to enable the portion of said layer of cooling liquid that rises over a pre-determined level (h) above said partition (21) to be drained outside.

9. Hood according to claim 6, characterized in that in said upper channel there is provided a nozzle (27), which is supplied with water flowing in from the water supply mains to generate an atomized jet in said serpentine-like flow-path.

10. Hood according to claim 9, characterized in that the stream of cooling liquid from said nozzle (27) is selectively controllable by an electromagnetic valve (29).

11. Hood according to claim 6, characterized in that, downstream of said condenser (11), said through-flow channel passes through a filtering member (14).

12. Hood according to claim 2, characterized in that said second intake aperture (5) is shaped and arranged as a planar or slightly curved mouth that is approximately as wide as the aperture ensuring access into the cooking cavity of an oven associated thereto.

13. Hood according to claim 12, characterized in that said second intake aperture (5) is inclined forwards over the upper edge of the access door to the cooking cavity from a position lying substantially above said access door.

14. Hood according to claim 1, characterized in that there is provided a fan (37) for circulating the air inside said cooking cavity (8), wherein said outflow port (35) is situated to enhance the flow of air from the secondary duct to said air circulating fan (37).

15. Hood according to claim 1, characterized in that there are provided programme sequence control means adapted to control the operation of said cooking oven, and adapted to determine the automatic operation of said functional parts of the hood, including the catalytic converter, the condenser, the fans and the electromagnetic valve, in accordance with the operating cycle being performed in said cooking oven.

* * * * *

UNITED STATES PATENT AND TRADEMARK OFFICE

CERTIFICATE OF CORRECTION

PATENT NO. : 7,588,025 B2
APPLICATION NO. : 11/334289
DATED : September 15, 2009
INVENTOR(S) : Raus et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 636 days.

Signed and Sealed this

Twenty-first Day of September, 2010

David J. Kappos

David J. Kappos
*Director of the United States Patent and Trademark Office*